US005221947A

United States Patent [19]

Ndebi et al.

[11] Patent Number: 5,221,947

[45] Date of Patent: Jun. 22, 1993

[54] INTERNALLY HEATED ROLLER ASSEMBLY FOR TONER IMAGE FIXING APPARATUS

[75] Inventors: Sylvain L. Ndebi, Rochester; Socrates Hryhorenko, Sodus, both of N.Y.

[73] Assignee: Eastman Kodak Company, Rochester, N.Y.

[21] Appl. No.: 839,172

[22] Filed: Feb. 20, 1992

[51] Int. Cl.[5] ..... G03G 15/20

[52] U.S. Cl. ..... 355/285; 355/282

[58] Field of Search ..... 355/282, 285, 290, 289; 219/216

[56] References Cited

U.S. PATENT DOCUMENTS

| | | | |
|---|---|---|---|
| 4,618,240 | 10/1986 | Sakurai et al. | 219/216 |
| 4,780,078 | 10/1988 | Masui | 355/289 X |
| 4,825,242 | 4/1989 | Elter | 219/216 X |
| 5,032,875 | 7/1991 | Gooray et al. | 355/290 |
| 5,094,613 | 3/1992 | Dolcimascolo et al. | 355/282 X |
| 5,115,119 | 5/1992 | Adachi et al. | 219/216 X |

*Primary Examiner*—A. T. Grimley
*Assistant Examiner*—Sandra L. Brass
*Attorney, Agent, or Firm*—Leonard W. Treash

[57] ABSTRACT

An internally heated roller assembly for a toner image fuser includes a roller having opposite ends. A lamp is supported inside the roller by a pair of lampholders, one positioned at each end. Each lampholder is fit over a core or gudgeons which extend from the ends of the roller. Each lampholder rotates with the roller. An internal cylindrical surface in each lampholder supports an extension from an elongated heating lamp positioned inside the roller. The lamp is held stationary by a cord protruding from one of the extensions while the holder rotates with respect to the extension while supporting it. Cylindrically shaped or arranged bearings are positioned around an outside cylindrical surface of the holder where the holder is fit on the core or gudgeons.

13 Claims, 2 Drawing Sheets

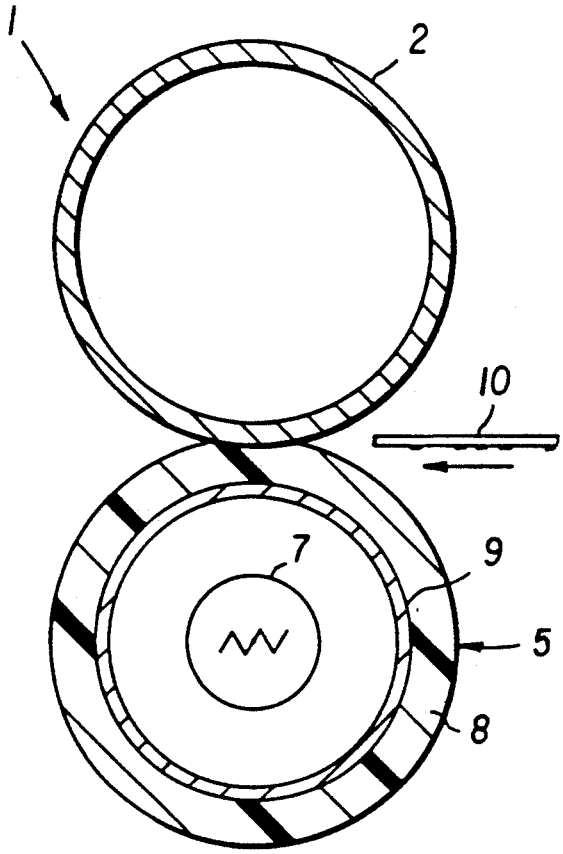
FIG. 1
FIG. 3
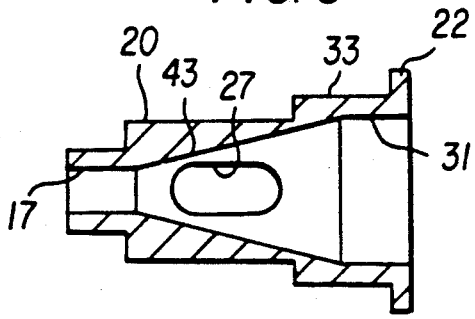
FIG. 4
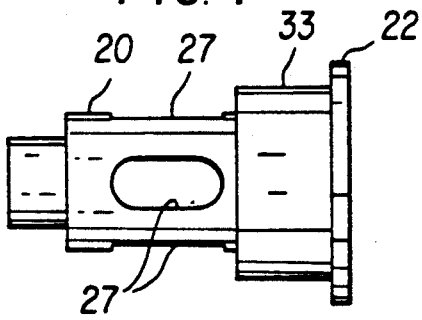
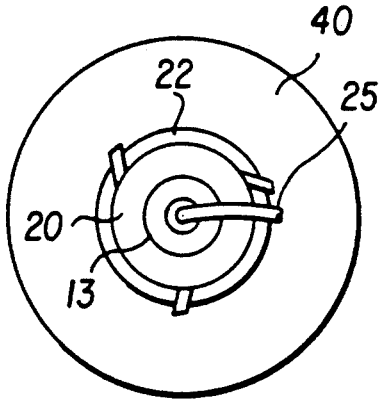
FIG. 5
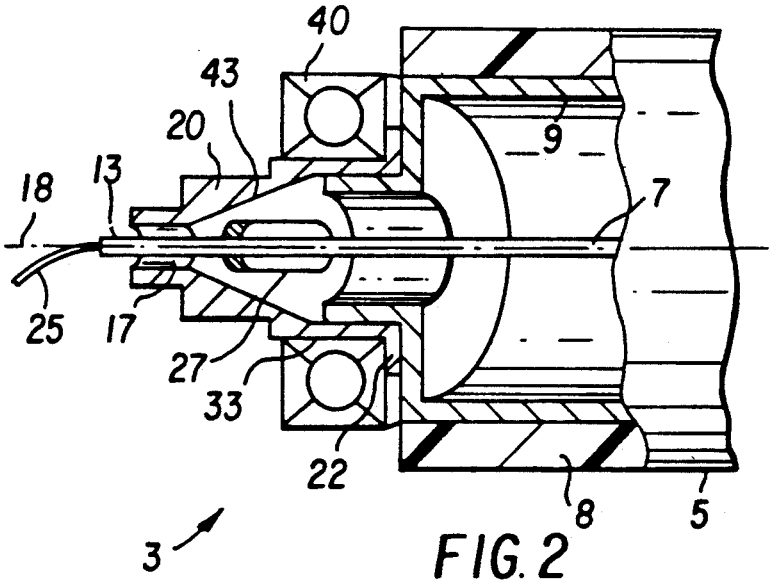
FIG. 2

INTERNALLY HEATED ROLLER ASSEMBLY FOR TONER IMAGE FIXING APPARATUS

This invention relates to the fixing of toner images to a receiving sheet. More particularly, it relates to an internally heated roller assembly for such apparatus.

BACKGROUND ART

Conventional toner image fixing apparatus employ one or more rollers which are internally heated. The largest use of an internally heated roller in such apparatus is to directly contact a toner image in a pressure nip. However, other rollers are also internally heated in some fusers. For example, it is known to heat the roller contacting the back of a receiving sheet carrying a toner image on its front and also to internally heat rollers which contact the outside surface of one or both of the nip-forming rollers to externally heat such rollers.

Typically, an internally heated roller includes a hollow metallic core in which an electrically powered lamp is positioned. The core is rotatable. For electrical contact and other reasons, the lamp is stationary. Conventionally, the opposite ends of the lamp are fixed to the frame of the apparatus and essentially suspended along the roller axis of rotation in the cavity. Assembly or replacement of a roller or lamp generally requires installation of the roller, positioning of the lamp inside the roller and attaching of the lamp at both ends to the frame.

STATEMENT OF THE INVENTION

It is an object of the invention to provide an internally heated roller assembly which is more simple than the prior art, especially in assembly and replacement.

This and other objects are accomplished by a roller having opposite ends and an internal cavity running between the ends along an axis of rotation. An elongated heating element is positioned in the internal cavity in the roller. The heating element has cylindrical extensions from each of its ends. A heating element holder is positioned at each end of the roller and is rotatable with the roller. The holder defines an internal cylindrical surface in which the extensions of the lamp are positioned.

According to a preferred embodiment, the heating element is held stationary by its power cord while the holder rotates. The cord exits the lamp through a bore in one of the cylindrical extensions. The roller itself is supported in the apparatus by support of its bearings which are mounted on the outside of the heating element holder. Inside the portion of the holder interfacing with the bearings is a large internal cylindrical surface which fits over a metallic core or gudgeons extending from the roller.

With this structure, a roller assembly including its heating element can be assembled outside the apparatus and inserted in the apparatus merely by affixing the bearings in an appropriate support.

According to a further preferred embodiment, the invention has particular utility in a fusing roller cartridge in which a fusing roller assembly is constructed according to the invention and totally assembled separate from the cartridge. The fusing roller assembly can then be positioned in the base of the cartridge in a relatively simple assembly operation.

DESCRIPTION OF THE DRAWINGS

FIG. 1 is an end section of a conventional roller fuser in which the invention is usable.

FIG. 2 is a perspective view of a heated roller assembly with most of the assembly shown in cross-section.

FIGS. 3 and 4 are a longitudinal section and a side view, respectively, of a lampholder shown in FIG. 2.

FIG. 5 is an end view of a roller assembly.

DESCRIPTION OF THE PREFERRED EMBODIMENTS

Figure 6:
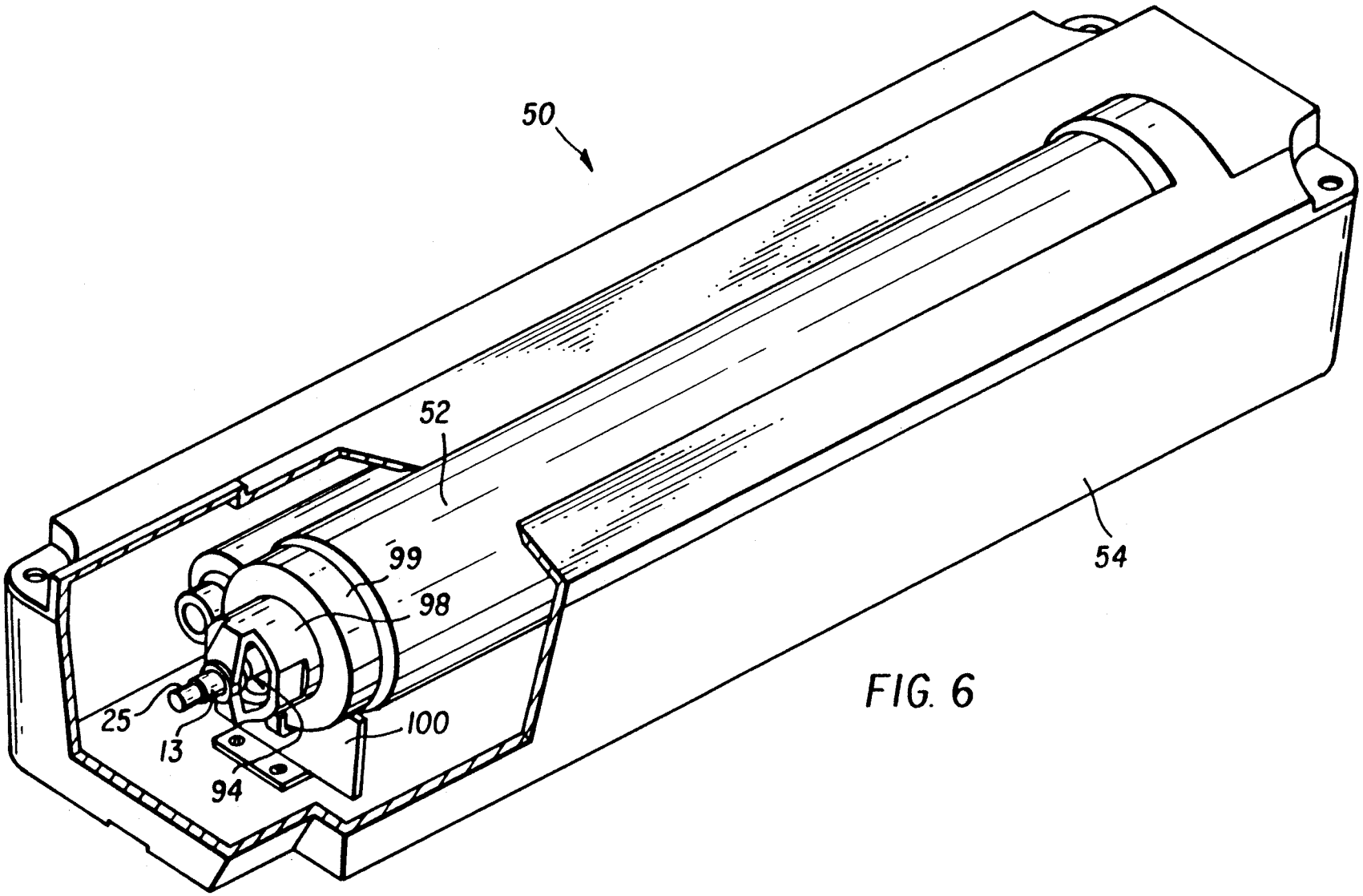
FIG. 6 is a perspective view of a fusing roller cartridge with portions cut away for clarity of illustration.

According to FIG. 1, a conventional roller fuser 1 includes an unheated, relatively hard pressure roller 2 and a relatively soft fusing roller 5. Fusing roller 5 includes a silicone rubber blanket 8 on a metallic core 9. Roller 5 is internally heated by a heating element, for example, a lamp 7 positioned in a cavity inside core 9. The fuser fixes a toner image to a receiving sheet 10 fed into the nip formed by the rollers.

According to FIG. 2, the internally heated fusing roller 5 is part of a roller assembly 3. Conventionally, lamp 7 must be stationary and accurately positioned inside rotating roller 5 during operation. It must also be connected to a source of power. In the prior art this has been accomplished by mounting the fuser roller, inserting the lamp and then connecting the ends of the lamp to the frame. Replacement of the fusing roller must go through the same elaborate procedure. As shown in FIG. 2, this process is greatly simplified by construction of a single assembly which includes the lamp fixed in the roller which can be mounted as a unit in fuser 1.

In FIG. 2, only the left end of roller assembly 3 is shown, but it will be understood that the other end is substantially duplicated. Metallic core 9 extends beyond each roller end. A molded plastic lampholder 20 is fit around core 9. Holder 20 has a flange 22 which abuts the end of roller 5.

Lamp 7 is of a conventional heating type for fusers, except that each end includes a cylindrical extension 13. Extension 13 is supported by holder 20 by a small internal cylindrical surface 17. Holder 20 also has openings 27 spaced around a middle portion.

As seen in FIG. 3, holder 20 has a large interior cylindrical surface 31 which fits on core 9 and an exterior cylindrical surface 33 (FIGS. 3 and 4) formed primarily of the opposite wall from cylindrical interior surface 31. Cylindrical bearings 40 are mounted on exterior cylindrical surface 33. A tapered surface 43 connects cylindrical surfaces 31 and 17.

Electrical power is supplied to lamp 7 with a cord 25 which fits in a bore in one (or both) of extensions 13.

The roller assembly 3 is mounted in fuser 1 by supporting bearings 40 at each end of roller 5 by conventional means, not shown in FIGS. 1-5 (but see FIG. 6). In operation, roller 5 is rotated by frictional contact with pressure roller 2. Roller 5 may alternatively be directly driven by suitable gearing from a motor or by gearing connecting to another roller which, in turn, is driven by a motor.

As roller 5 rotates, holder 20 has a tendency to rotate with it because of a relatively snug fit with core 9. The external surface 33 of holder 20 rides on bearings 40. Bearings 40 abut flange 22, keeping holder 20 on core 9. While roller 5 and holder 20 rotate, lamp 7 is held stationary, primarily by cord 25. Internal cylindrical surface 17, thus rotates on extension 13 while supporting it and lamp 7. With identical holders 20 at opposite ends of roller 5 supporting identical extensions 13, lamp 7 is supported symmetrically about the axis of rotation 18 of roller 5. Holder 20 is made of heat insulating plastic. The portion between surfaces 31 and 33 and the flange 22 prevent much of the heat from core 9 from reaching bearing 40.

Assembly of lamp 7 in roller assembly 3 involves merely fitting extensions 13 into surfaces 17 and surfaces 31 on core 9. Tapered surface 43 inside holder 20 assists in fitting extensions 13 in surface 17. With this structure, the entire roller assembly 3 shown in FIG. 2 can be assembled separately. It can be mounted in the apparatus as a unit merely by securing bearings 40 to their appropriate supports. Separate mounting of the lamp by the serviceman or final assembler is not necessary.

FIG. 4 is a longitudinal side view of holder 20 showing minor variations from that of FIGS. 2 and 3. In FIGS. 2 and 3, there are two openings 27, while in FIG. 4 there are four such openings. In a high-speed fuser these openings perform an additional function of stirring the air in the vicinity of the lamp which substantially exchanges air at both ends of the lamp, thereby maintaining relative coolness at those points. For additional cooling action by the rotation of holder 20, fins can be introduced. This embodiment is shown in an end view in FIG. 5 which shows a roller assembly which is otherwise identical to that of FIG. 2.

A different embodiment and particularly attractive use of this roller assembly is shown in FIG. 6. According to FIG. 6, a fusing roller cartridge 50 having a housing 54 is used to replace a fusing roller 52 by simple operator insertion. Assembly of the cartridge itself is facilitated by a fusing roller assembly similar to that shown in FIG. 2. In this instance, at each end of fusing roller 52, a molded plastic lampholder 98 is fit over a gudgeon, not shown, with which it rotates as in the FIG. 2 apparatus. A fusing lamp 94 having an extension 13, as in FIG. 2, is supported by an internal cylindrical surface of holder 98. The holder 98 rotates inside of bearings 99 which are supported by a fusing roller or bearing support 100 attached to an internal base of the housing 54 of cartridge 50. Holder 98 has openings similar to those shown in the other embodiments, which causes some circulation of air, depending on the speed of rotation of roller 52.

This structure allows the fusing roller and its lamp to be mounted in the cartridge merely by support of bearings 99 and without concurrent assembly of fusing lamp 94. It also allows the fusing roller and lamp assembly to be made separate from the assembly of the cartridge and stocked as a complete assembly itself. Because of the ease in fitting lampholders 98 over extensions 13 and over the gudgeons, assembly of the lamp in roller 52 is also simple.

The invention has been described in detail with particular reference to a preferred embodiment thereof, but it will be understood that variations and modifications can be effected within the spirit and scope of the invention as described hereinabove and as defined in the appended claims.

We claim:

1. For use in apparatus for fixing a toner image to a receiving sheet, an internally heated roller assembly comprising:

a roller having opposite ends and an internal cavity running between the ends along an axis of rotation each end including a protruding core or gudgeon defining an external cylindrical surface, an elongated heating element positioned in the internal cavity in said roller, said heating element having cylindrical extensions from each end, and a heating element holder positioned at each end and rotatable with said roller, each holder having a first internal cylindrical surface supporting said cylindrical extension which surface is rotatable with respect to said extension and a second internal cylindrical surface which fits over said external cylindrical surface.

2. The roller assembly according to claim 1 further including an electrical lead extending from said heating element out of said roller through a bore in one of said extensions.

3. The roller assembly according to claim 1 further including means for preventing axial movement of said holders.

4. A roller assembly according to claim 1 further including bearings at each end of said roller having an internal cylindrical surface and wherein each of said holders further defines an external cylindrical bearing surface upon which said bearings are mounted.

5. A roller assembly according to claim 1 wherein each of said holders has a tapered surface adjoining the first internal cylindrical surface to assist insertion of the cylindrical extension in said first internal cylindrical surface.

6. A roller assembly according to claim 5 which said tapered surface connects the first and second internal cylindrical surface.

7. A roller assembly according to claim 4 wherein each of said holders includes an outwardly extending flange which is engaged by said bearings to prevent axial movement of said holders.

8. A roller assembly according to claim 4 wherein said holder is constructed of a heat insulating material to reduce heating of said bearings.

9. A roller assembly according to claim 1 wherein said holder includes openings through which air can flow to cool the ends of said heating element.

10. A roller assembly according to claim 9 further including fins associated with said openings in said holder to direct air into said holder in response to rotation of said holder.

11. A roller assembly according to claim 1 further including a fusing roller cartridge comprising:

a cartridge housing having an internal base, and a fusing roller positioned in said base, which fusing roller is part of the internally heated roller assembly constructed.

12. A lampholder for use in a roller assembly, which roller assembly includes a roller having an internal cavity for a lamp, a core or gudgeons having an external cylindrical surface extending from each end of the roller, an elongated lamp positioned in the cavity in the roller and having a cylindrical extension from each end of the lamp, said lampholder comprising:

means defining a first internal cylindrical surface for receiving an extension of the heating lamp, and means defining a second internal cylindrical surface for fitting over the core or gudgeons of the roller.

13. A lampholder according to claim 12 wherein said first internal cylindrical surface is positioned at one end of the holder and the second internal cylindrical surface is positioned at the other end of the holder and wherein said holder further includes a flange extending away from an axis of rotation of the holder adjacent the second internal cylindrical surface.

* * * * *

UNITED STATES PATENT AND TRADEMARK OFFICE

CERTIFICATE OF CORRECTION

PATENT NO. : 5,221,947

DATED : June 22, 1993

INVENTOR(S) : Sylvain L. Ndebi, et. al.

It is certified that error appears in the above-indentified patent and that said Letters Patent is hereby corrected as shown below:

Column 4, Claim 6, line 29, delete "which and substitute --wherein--.

Signed and Sealed this

Twenty-second Day of February, 1994

*Attest:*

Bruce Lehman

BRUCE LEHMAN

*Attesting Officer*

*Commissioner of Patents and Trademarks*